United States Patent [19]

Wynar

[11] Patent Number: 4,719,729

[45] Date of Patent: Jan. 19, 1988

[54] REUSABLE METAL WALL FRAME

[76] Inventor: Roger N. Wynar, 19 Parkside Ave., Hamburg, N.Y. 14075

[21] Appl. No.: 900,764

[22] Filed: Aug. 27, 1986

[51] Int. Cl.[4] ..... E06B 1/04

[52] U.S. Cl. ..... 52/211; 52/212; 52/717.1

[58] Field of Search ..... 52/211, 212, 213, 214, 52/718, 717, 716, 656, 287, 288; 49/504

[56] References Cited

U.S. PATENT DOCUMENTS

| | | | |
|---|---|---|---|
| 2,741,344 | 4/1956 | Herr | 52/211 |
| 3,337,925 | 8/1967 | Meyer | 52/717.1 X |
| 3,401,487 | 9/1968 | Brandt et al. | 52/211 X |
| 3,429,076 | 2/1969 | Fortsh et al. | 52/211 X |
| 3,884,003 | 5/1975 | Herr et al. | 52/214 X |
| 4,021,988 | 5/1977 | Edeus et al. | 52/656 |
| 4,094,112 | 6/1978 | Smith et al. | 52/211 |
| 4,238,909 | 12/1980 | Mutton | 49/504 |
| 4,308,692 | 1/1982 | Rumble et al. | 52/211 X |
| 4,527,369 | 7/1985 | Adams | 52/211 |

*Primary Examiner*—Carl D. Friedman

[57] ABSTRACT

Inconspicuously attached separable assemblies, useful for door framing and the like, comprised of elongate, configurated "U" channel jamb runners secured to ordinary walls and partitions with fasteners, headed so as to cooperate with the jamb runners to engage elongate casing covers. Further disclosed are jamb runner corner alignment clips configurated for simple field attachment without tools or fasteners.

3 Claims, 8 Drawing Figures

Fig. 5
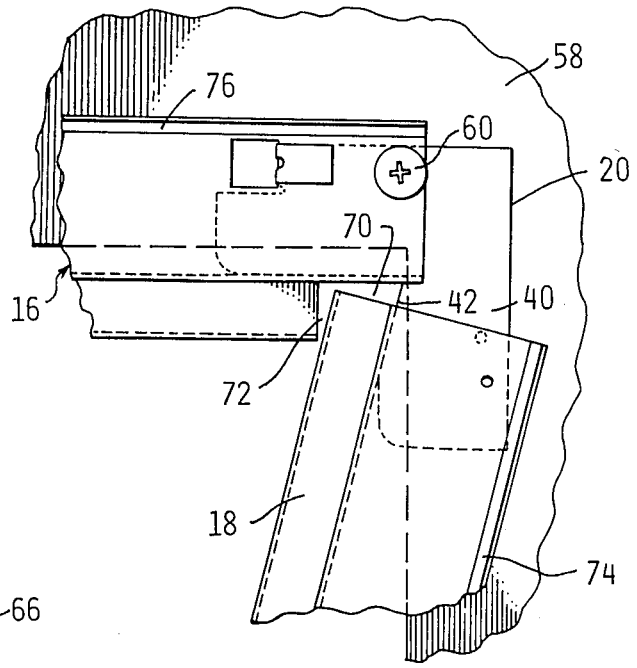
Fig. 6
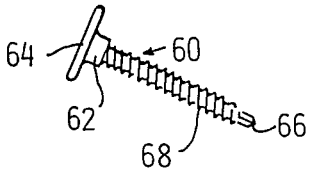
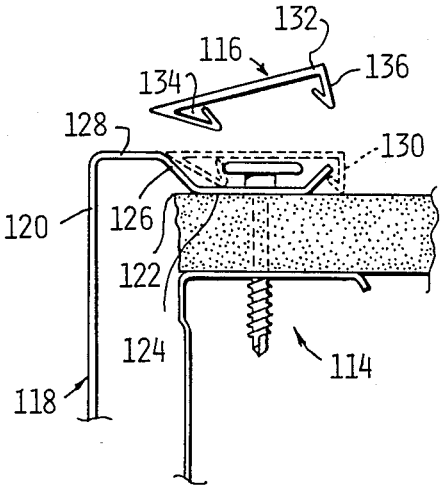
Fig. 8
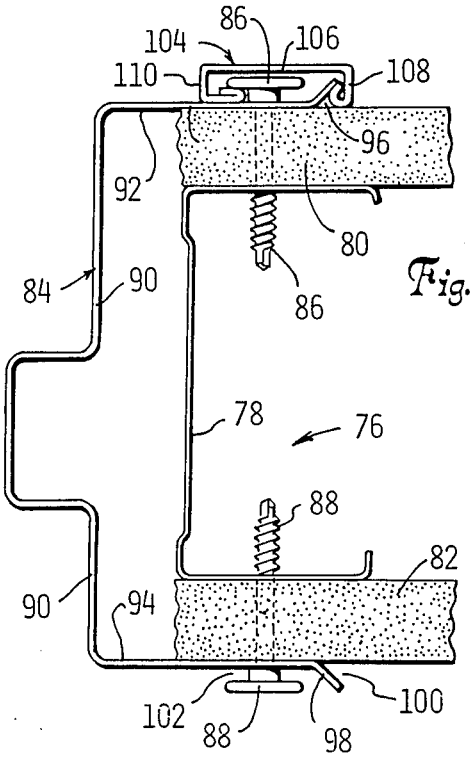
Fig. 7

REUSABLE METAL WALL FRAME

BACKGROUND OF THE INVENTION

1. Field of the Invention

The present invention relates to decorative frames useful to cover and disguise unfinished terminal portions, including door and window openings of fabricated wall constructions.

2. Description of the Prior Art

It is a common practice today, particularly in commercial buildings to construct walls and partitions that may be conveniently relocated with little disruption of occupant activity. These demountable walls are enhanced with reusable metal framing for door and window openings; however, such frames heretofore have involved complicated fabrication and assembly not possible with job-site tools and labor skills normally encountered in this field.

3. Object of the Invention

It would be desirable, and is therefore an important object of the invention, to provide easily installed, removable and reusable jamb assemblies, useful for door frames and the like in normal wall and partition constructions.

It would be additionally beneficial, and therefore another object of the invention, to provide a frame secured with fasteners that also serve as casing retainers, eliminating normal factory installed retaining devices.

It would be additionally beneficial, and is therefore another object of the invention, to provide a rigid corner alignment clip that may be field attached to the jambs without tools or fasteners.

It is a concomitant object of the invention to provide frames with jamb profiles configurated to disguise inconspicuously attached, flush casing covers.

SUMMARY OF THE INVENTION

All the objects and goals of the invention are attained with the present invention which also overcomes the above mentioned disadvantages of the previously known frames.

In brief, door jambs and the like are elongate "U" channel frames of formed sheet material, usually steel or aluminum, comprised of a web portion configurated to act as a door jamb or the like, a pair of wallboard surface contacting flange portions extending from opposite sides of said web portion, each terminating with an outwardly directed casing retainer portion. Intersecting "U" channel frames are orientated with field attached, modified "L" shaped corner alignment clips. The "U" channel frames are attached to the walls with shoulder fasteners configurated with washer heads, spaced from said flanges to engage elongate, substantially "C" channel shaped, resilient casing covers. Also disclosed are somewhat omega shaped channel frames, configurated to cooperate with flush fitting, modified "C" channel casing covers.

BRIEF DESCRIPTION OF THE DRAWINGS

FIG. 5 is a profile view of a partially installed framed corner fragment.

FIG. 6 is a side view of a typical shoulder and washer headed, frame fastener.

FIG. 7 is a cross sectional view of a wall fragment with an installed, partially cased, door jamb frame.

FIG. 8 is a cross sectional view of a wall fragment similar to FIG. 7 illustrating an alternate frame and flush casing configuration.

DESCRIPTION OF A PREFERRED EMBODIMENT

Figure 1:
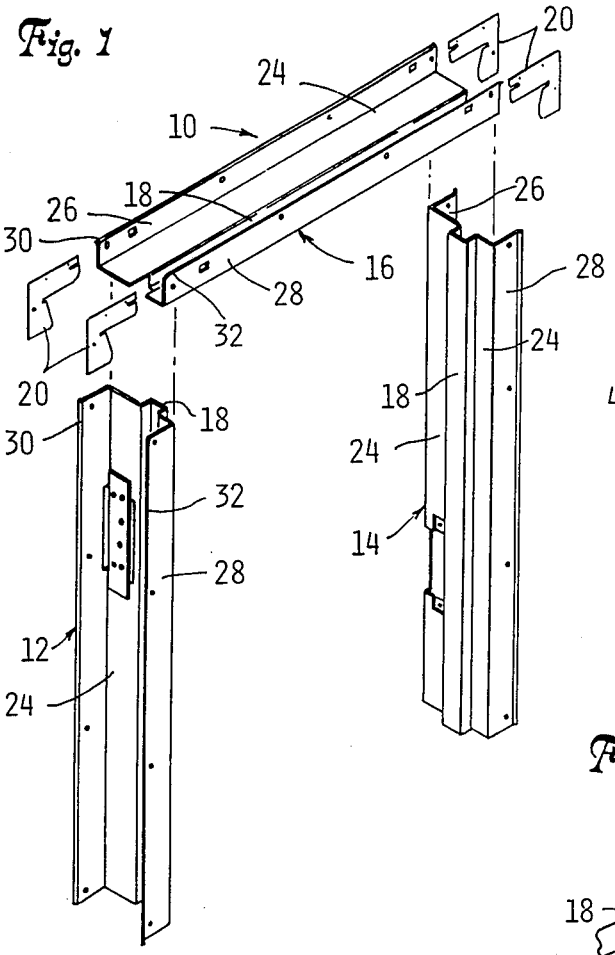
FIG. 1 is an exploded isometric view of a frame assembly with jambs configurated for hinged door installation.

In FIG. 1 shows an unassembled frame 10 with three substantially "U" shaped channel runners including a hinge jamb 12, a strike jamb 14 and a header jamb 16, all configurated with integral door stop portions 18 and two pairs of corner alignment clips 20 and 22. Hinge jamb 12 and strike jamb 14 have square cut-off terminal ends while header jamb 16 has stop portion 18 material removed at both terminal ends to accommodate hinge and strike jamb stop portions as better shown in FIG. 2. It should be noted that with the exception of said cutback stop portions of the header jamb, all jamb runners have identical cross sections and are in fact produced on the same tooling. In addition to the stop portions 18 previously mentioned, each "U" channel jamb includes a substantially flat web portion 24, of sufficient width to traverse opposite wall sides, pairs of essentially perpendicular flange portions 26 and 28 extending from opposite sides of said web portion, each terminating with an outwardly directed casing retainer portion 30 and 32. While web portions 24 are illustrated with intrinsic door stop portions 18, it is possible to configurate the web portion for other uses such as glazing frames (which might have inwardly directed channels) or flush surfaced partition terminals.

Figure 3:
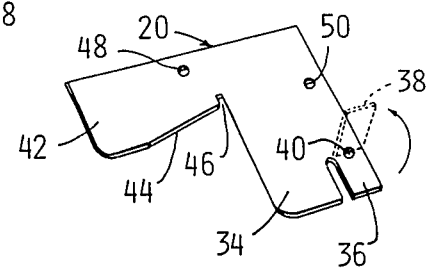
FIG. 3 is a perspective view of corner alignment clip including phantom tab movement.
Figure 2:
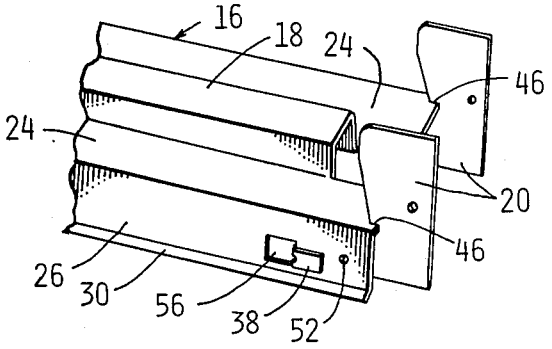
FIG. 2 is a perspective view of a door jamb frame runner fragment with a pair of attachment clips attached.

In FIG. 2, header jamb fragment 16 has a pair of attached corner alignment clips 20 fully shown in FIG. 3 where modified "L" shaped corner clip 20, formed of a planiform sheet of thin metal has a rectangular first leg 34 with integral tab 36 also shown in phantom deflected position 38, said tab controlled with weakening hole 40, a trapezoidal second leg 42, perpendicular to said first leg with a converging inward edge 44 terminating at web engaging slot 46 intersecting said first and second leg portions. Screw clearance holes 48 and 50 are provided to coincide with flange holes 52, best shown in FIGS. 2 and 4.

Figure 4:
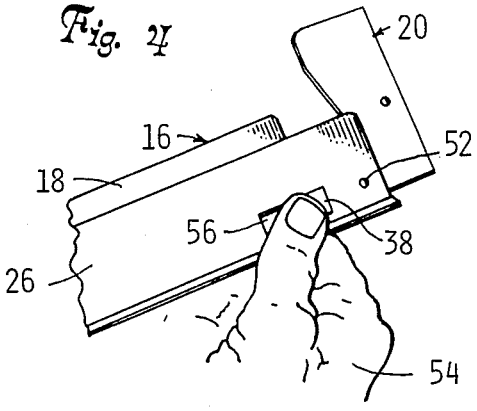
FIG. 4 is a pictoral view showing corner alignment clip installation.

In FIG. 4 mechanic 54 (hand only), has installed corner clip 20 by sliding leg 34 along web inside surface (unseen) and directing deflected tab 38 through aperture 56 in flange 26. It may be seen in FIG. 2 that slot 46 engages web 24 to prohibit movement of the installed clips.

In FIG. 5 inside wall corner 58 has header jamb 16 with attached corner clip 20 installed with plurality of frame fasteners 60 (one shown) also shown in profile in FIG. 6 where the fastener 60 has shoulder 62 to space washer head 64 from the flange surface. The illustrated fastener has a drill pointed 66, threaded shank 68 to be compatable with normal metal stud drywall construction; However, nail or other fastener configurations are also useful. Returning to FIG. 5, it may be seen that corner clip 20, trapezoidal leg 40 with convering side 42 provides ample clearance 70 for stop portion 18 of strike jamb 14. As the jamb 14 is urged toward the vertical positon the camming effect of leg 40 closes stop joint 72 very tightly. Also apparent in this view is the lead-in advantage of the outwardly directed casing retainer portions 74 and 76 since the wallboard is often surfaced with fragile vinyl film.

FIG. 7 shows a cross sectional view of a typical drywall partition 76 with metal stud 78 and wallboards 80 and 82. Jamb frame 84, installed with screw fasteners 86 and 88 has a door stop configurated web portion 90, a pair of wall surface contacting flange portions 92 and 94, each terminating with outwardly directed casing retainer portions 96 and 98. Wall/retainer trough 100 and flange/screw race 102 provide for the attachment of resilient "C" channel casing cover 104 comprised of intermediate web portions 106, a first, trough engaging, protuberant leg portion 108, a second, race engaging, protuberant leg portion 110. The channel casing cover may be configurated of any resilent material such as formed metal or extruded plastic. Casing 104 is shown positively locked under a washer head screw is but an example since any bulbous head fastener configuration could be used.

FIG. 8 shows a wall fragment 114, similar to FIG. 7 with a less conspicuous casing cover 116 since the frame 118 has a web portion 120 that extends beyond the width of the wall 122 and the flange 124 has an angled portion 126 to return to the wall surface. This configuration extends the exposed flange surface 128 flush with the installed casing cover surface 130 or a unitary appearance. Casing cover 116, comprised of a intermediate web portion 132, a first, race engaging, "V" shaped leg portion 134 and a second, trough engaging "J" shaped leg portion 136.

It is thought that reusable metal wall frames of the present invention and many of its attendant advantages will be understood from the foregoing description and it will be apparent that various changes may be made in the form, construction, material and arrangement of the parts thereof without departing from the spirit and scope of the invention or sacrificing all of its material advantages, the form hereinbefore described being merely a preferred or exemplary embodiment thereof.

What is claimed as new and desired to be secured by Letters Patent of the United States is:

1. Inconspicuously attached, separable assemblies, especially useful for door and window frames in normal wall and partition construction, said frames comprised of:

(a) substantially U channel shaped, elongate jamb runners, each including a wall traversing web portion, a pair of wall surface contacting flange portions extending essentially perpendicular from opposite sides web portion, said flange portions including outwardly directed terminal edges;

(b) a plurality of dual purpose, jamb runner/casing cover fasteners, each including an enlarged washer head portion, spaced from said flange portions by a reduced diameter, flange abutting, shoulder portion, and a further reduced diameter, subsurface engaging, shank portion; and (c) substantially C channel shaped, elongate, resilient casing cover runners, each including a web portion intermediate a first, protuberant leg portion, engaging said washer head portion of said jamb runner/-casing cover fastener and a second protruberant leg portion engaging said outwardly directed terminal edge of said jamb runner flange portion.

2. Inconspicuously attached, separable assemblies, especially useful for door and window frames in normal wall and partition construction, said frames comprised of:

(a) Substantially omega, channel shaped, elongate jamb runners, each including a wall traversing web portion extending beyond the width of said wall a pair of flange portions extending essentially perpendicular from opposite sides of said web portion over and spaced from opposite wall side surfaces thence angularly returning to and along said wall side surfaces, said flange portions including outwardly directed terminal edges;

(b) a plurality of dual purposes, jamb runner/casing over fasteners, each including an enlarged washer head portion, spaced from said flange portions by a reduced diameter, flange abutting, shoulder portion, and a further reduced diameter subsurface engaging, shank portions; and, (c) substantially C channel shaped, elongate, resilient casing cover runner, each including a web portion intermediate a first, protuberant leg portion, engaging said washer head portion of said jamb runner/-casing cover fastener and a second protuberant leg portion engaging said outwardly directed terminal edge of said jamb runner flange portion.

3. Demountable frames useful for door and window surrounds, each frame assembly comprised of:

(a) first and second right angle abutting, substantially U channel shaped jamb runners each including wall traversing web portions, pairs of apertured flange portions, extending essentially perpendicular from opposite sides of said web portions, said abutting jamb runner orientation controlled by;

(b) field appendable pairs of L shaped, planiform profiled, corner clips, each struck from thin, malleable sheet material, each clip including:

(1) a first, substantially rectangular leg, cohered along inside flange surfaces of said first jamb runner, with integral tab portions outwardly rotated through said apertures in said flange portions;

(2) a second, substantially rectangular leg, extending perpendicularly from said first leg along inside flange surfaces of said second jamb runner, said second leg slotted at the inside corner of the L shaped clip to extend partially beyond and tightly abut said first jamb, web portion; and, (c) a separable casing or covering means to conceal said corner clip tab portions and said apertures in said flange portions.

* * * * *